United States Patent [19]

Remy et al.

[11] Patent Number: 4,655,069

[45] Date of Patent: Apr. 7, 1987

[54] AUTOMATIC MACHINE FOR CURVING THIN AND RECTILINEAR ELEMENTS, SUCH AS METAL WIRES

[75] Inventors: Michel Remy, Raon l'Etape; Jean-Francois Delaite, Nompatelize; Guy Woirgard, Thiaville, all of France

[73] Assignee: Autocoussin, Paris, France

[21] Appl. No.: 756,975

[22] PCT Filed: Oct. 31, 1984

[86] PCT No.: PCT/FR84/00245

§ 371 Date: Jul. 2, 1985

§ 102(e) Date: Jul. 2, 1985

[87] PCT Pub. No.: WO85/01898

PCT Pub. Date: May 9, 1985

[30] Foreign Application Priority Data

Nov. 2, 1983 [FR] France ..... 83 17379

[51] Int. Cl.[4] ..... B21F 45/00; B21D 11/00

[52] U.S. Cl. ..... 72/306; 72/142; 72/309; 72/311; 140/71 R

[58] Field of Search ..... 72/305, 306, 308, 309, 72/310, 311, 142, 145, 388; 140/71 R

[56] References Cited

U.S. PATENT DOCUMENTS

| | | | |
|---|---|---|---|
| Re. 27,021 | 1/1971 | Ott | 140/71 R |
| 3,045,740 | 7/1962 | Davis | 140/71 R |
| 3,245,433 | 4/1966 | Taylor | 140/71 R |

FOREIGN PATENT DOCUMENTS

| | | |
|---|---|---|
| 3236663 | 7/1983 | Fed. Rep. of Germany . |
| 1011988 | 12/1965 | United Kingdom . |

*Primary Examiner*—E. Michael Combs

[57] ABSTRACT

The present invention provides an automatic machine for curving thin and rectilinear metal elements of the wire, strip or tube type.

According to the invention, this machine comprises a nipper (2) adapted for positioning and holding on a first axis (X) a metal element section to be bent, as well as two bending devices (3, 4) movable on each side of the nipper (2) along a rail (7) parallel to the axis (X). Each bending device comprises two jaws (17 and 18) between which the metal element section may be clamped at each stop of the bending device, as well as a bending finger adapted for rotating about an axis perpendicular to the axis (X) in line with the noses of the jaws (17, 18) which form the counter bending parts. According to an essential characteristic of the invention, the nipper (2) may further execute an angular rotation about the axis (X).

12 Claims, 6 Drawing Figures

AUTOMATIC MACHINE FOR CURVING THIN AND RECTILINEAR ELEMENTS, SUCH AS METAL WIRES

The present invention relates to a machine for curving thin and rectilinear metal element sections of the wire, strip or tube kind, this machine comprising positioning means for holding on a first axis a first metal element section to be bent, and at least one bending member which cooperates with a counter-bending part placed on said first axis and which, on the one hand under the action of a first drive mechanism, may be driven with an angular rotational movement about a second axis perpendicular to the first one and aligned with the counterbending part and, on the other hand by means of a second drive mechanism, may be moved with a reciprocal movement along a third axis parallel to the second one, said bending member being moreover movable, jointly with the counter-bending part, in a direction parallel to the first axis.

In machines of this type, which are currently used for curving metal wires with a view more particularly to manufacturing bent wire articles, the angular rotational movement of the bending member takes place, at each bending cycle, between the outgoing and return travels of its reciprocal movement.

With the succession of these movements, the bending member can first of all be brought into lateral contact with the wire, then rotated through a certain angle, in one direction or the other, so that it bends the wire about the counter bending part and finally retracted before the bending member is moved with the counter bending part. The amount of bending of the wire depends on the angle through which the bending member is caused to rotate, and the advancing pitch of this latter determines the length of the bent wire segment.

Although these machines offer entire satisfaction when they are used for forming bends in one and the same plane, it is known that every attempt made to adapt them for bending wires in all directions in space more especially with a view to manufacturing carcases or skeletons for motor vehicle seats, have not up to now succeeded in providing simple solutions ensuring a high production rate. The problems arising from bending wires in all directions in space are further aggravated when it is desired to form in succession, singly or in small scale or medium scale mass production, wires bent in different spatial configurations.

The present invention proposes a curving machine which, while being simple in structure and automatic in operation, ensures high production rates and, with a loss of time reduced to the minimum, allows bent wires to be formed in succession with different spatial configurations, this machine being further of great flexibility in use in that it can bend wires of any diameter but also other thin and elongate metal elements, such as strips and tubes.

According to the invention, this curving machine, which is of the type specified in the preamble, is characterized in that the means for positioning the metal element section to be bent comprise, on the one hand, a nipper adapted for immobilizing, on said first axis, the metal element section to be bent and, on the other hand, a pair of jaws movable jointly with the bending member and one at least of which is mobile, the noses of these jaws forming said counterbending part, said nipper being further mounted for rotation about the first axis and associated with a third drive means adapted for imparting thereto an angular rotation about this axis.

Rotation of the nipper allows the orientation of the bending member to be modified at will, with respect to the wire, in a plane perpendicular to this latter and consequently the bending member may, whenever it stops along the wire, curve this latter in a different spatial direction.

In a preferred embodiment, the curving machine of the invention comprises two bending members each associated with a counter-bending part and disposed on each side of the nipper.

As will be readily understood, this arrangement allows the production rate of the machine to be doubled. It should be further noted that, on each side of the nipper, the two bending members may bend the wire in completely different spatial configurations without this production rate being affected thereby.

Advantageously, the nipper is formed by a disk having a radial slit opening onto its periphery and mounted for rotation about its center on a support arm fixed to the frame of the machine, this disk further comprising means for clamping the metal element section to be bent.

With such a structure, the nipper opposes an extremely reduced inertia to its rotation.

Preferably, the clamping members are formed by blocks projecting from the edges of the slit opposite each other in the center of the disk, one at least of these blocks being mobile and movable against the action of a resilient element which urges it towards the other block.

Moreover, the curving machine of the invention comprises a means for moving the mobile block, formed by an actuating cylinder whose rod, in a certain angular position of the disk, comes into alignment with a bore of this latter, open at its periphery, in which slides a rod secured to the mobile block.

In a preferred embodiment, the third drive mechanism for rotating the disk comprises a motor coupled to a shaft whch has, on part at least of its length, teeth engaging with a toothed ring carried by the periphery of the disk and tangent to the shaft.

According to another characteristic of the invention, each bending member is formed by a bending finger mounted for sliding along said third axis in a support head which has an axis of symmetry forming the second axis and which is maintained in rotation about this latter inside a frame movable along a rail parallel to the first axis.

This bending finger is of very reduced weight and opposes a practically negligeable inertia to the actuation of its moving mechanism. Consequently, its reciprocal movement is instantaneous, which has a favorable influence on the working speed and productivity of the curving machine of the invention.

Moreover, the first mechanism for driving the bending finger comprises an endless chain extending parallel to the first axis about two toothed wheels one of which is fixed coaxially about the support head and the other is supported by a shaft mounted for free rotation in the frame, parallel to the axis of rotation of the support head, one of the sides of the endless chain being connected to the free end of the rod of an actuating cylinder which is parallel thereto.

Preferably, the endless chain is a silent chain and the free end of the rod of the actuating cylinder is mounted for sliding along a guide rail parallel to the rod.

This method of rotating the bending member has the advantage, on the one hand, of being of very high precision in so far as the repeatability of the bending angles is concerned and, on the other hand, of producing very small angular rotations down to 1/10 of a degree.

In addition, the second mechanism for driving the bending finger comprises an actuating cylinder secured to the frame whose rod passes in free sliding relation through the support head along the axis of rotation of this latter, the free end of this rod being connected to the bending finger by a rotary lateral connection.

Finally, according to another important characteristic of the invention, the first, second and third drive mechanisms as well as the system for controlling the jaws and that for moving the bending members, are actuated in synchronism by a programmable digital control with assisted programming.

This arrangement considerably increases the productivity of the machine of the invention in the case of medium scale, even very small scale industrial production. In fact, the operations of the drive mechanisms and of the system for controlling the movement of the bending members, which determine the bending parameters, are controlled in synchronism by a program which contains a succession of digital instructions and which may be recorded on a conventional magnetic tape cassette. Thus, passing over from one type of manufacture to another simply requires changing the cassette in the reading apparatus of the digital control desk, which change may be carried out in a very short time of the order of two minutes.

One embodiment of the present invention will now be described by way of non limitative example with reference to the accompanying drawings in which.

Figure 1:
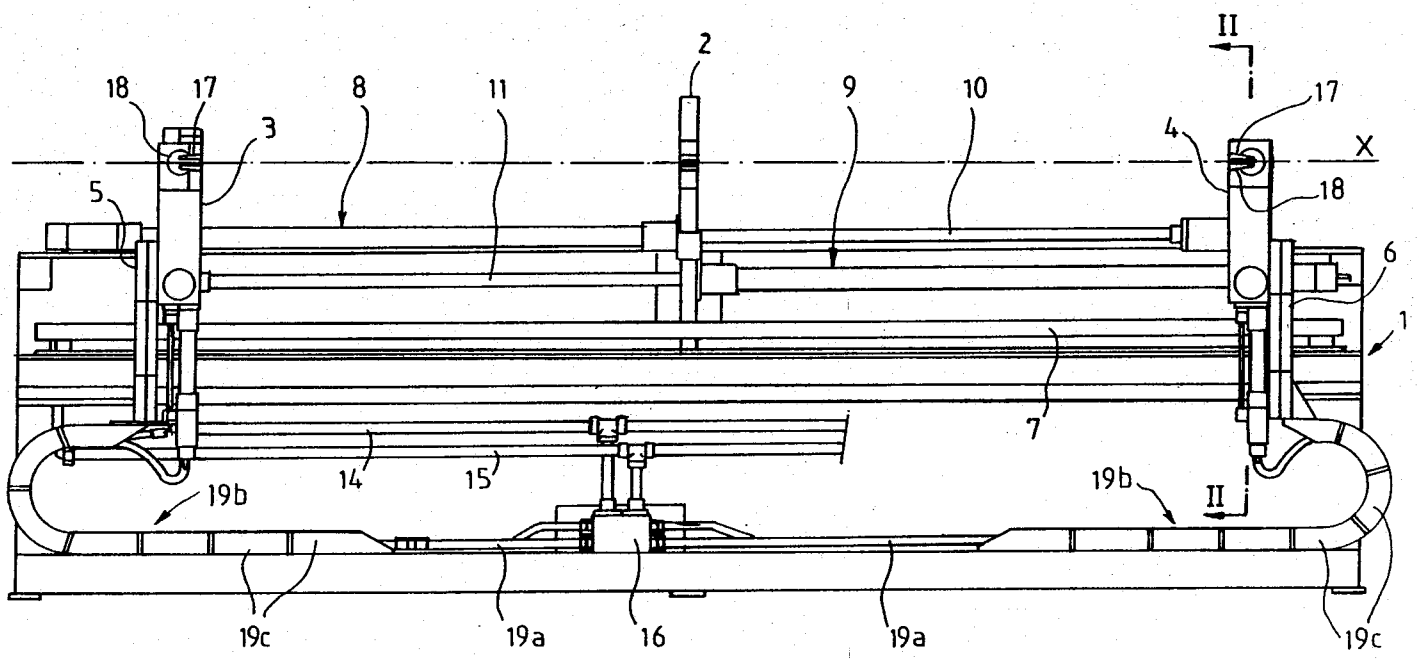
FIG. 1 shows a general view of this embodiment of the curving machine of the invention.

The curving machine shown in FIG. 1 comprises a bench 1 on which is mounted, substantially at mid-length, a support nipper 2 which, according to the first characteristic of the invention may effect an angular rotation about a horizontal axis X which passes through its center.

The bench 1 further supports, situated on each side of the support nipper 2, two identical bending devices 3 and 4 which, through a lateral support frame 5, 6, are mounted for sliding on a cylindrical horizontal rail 7 fixed to bench 1. Two hydraulic cylinders 8, 9 of great length, supported by bench 1, are further provided for moving the bending devices through successive steps along rail 7, respectively on one side and on the other of the support nipper 2. Rods 10, 11 of these two cylinders 8, 9, which are respectively secured to the bending devices 3 and 4, extend in opposite directions in a horizontal direction. The intake and discharge of the working fluid into and from the bodies of the two actuating cylinders are provided through ducts 14, 15 connected by means of a relay 16 to a hydraulic unit not shown.

Figure 2:
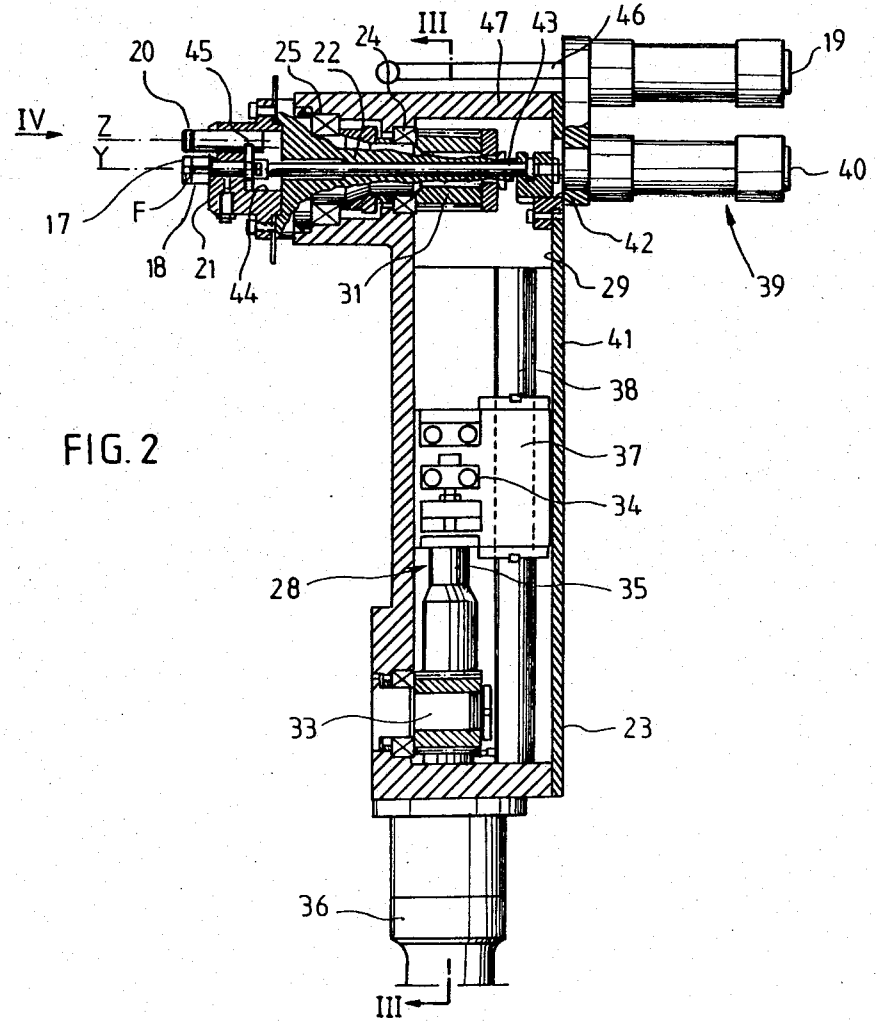
FIG. 2 is a sectional view of one of the bending devices of this machine, taken along the line II—II of FIG. 1.

It will be further observed in FIG. 1 that each of the bending devices 3 or 4 has, on a vertical flat face, two jaws 17, 18 mounted on each side of the axis of rotation X of the support nipper 2, the upper jaw 17 being moved away from the lower jaw 18 by means of an hydraulic cylinder 19 which can be seen in FIG. 2 which shows in section one of the bending devices 3 or 4.

As can be seen in this Figure, the essential part of this bending device is formed by a bending finger 20 projecting from the front face 21 of a support head 22 mounted for rotation about its axis of symmetry Y and, through two bearings 24, 25 in a frame 23, the axis of rotation Y of the support head 22 being horizontal and perpendicular to the axis of rotation X of the support nipper 2. Furthermore, the bending finger 20 is offcentered with respect to this axis of rotation Y, as can be clearly seen in FIG. 4 which also shows that the two jaws 17, 18 mentioned above are supported by the front face 21 of the support head 22 while being positioned so that their noses 26, 27 stop in line with the axis of rotation Y of this latter.

The support head 22 may be driven with an angular rotational movement under the action of a first drive mechanism 28 housed in an inner cavity 29 of frame 23.

Figure 3:
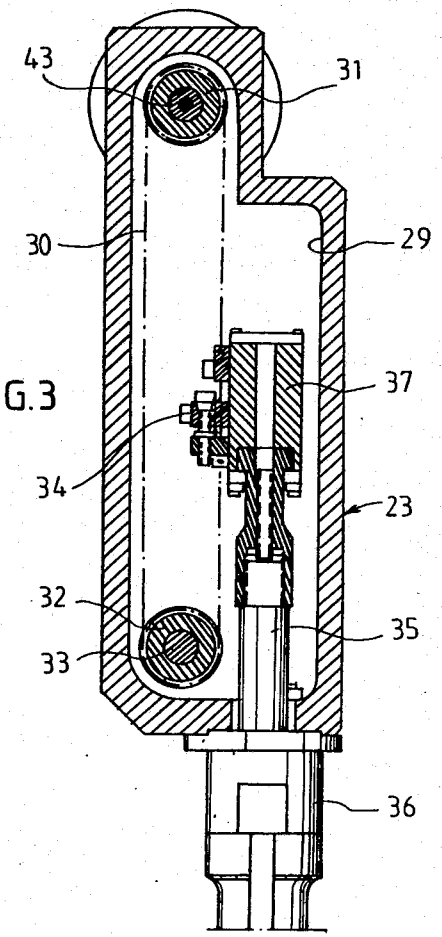
FIG. 3 is a sectional view along line III—III of FIG. 2.

Referring simultaneously to FIGS. 2 and 3, it can be seen that this first drive mechanism 28 comprises an endless chain 30, preferably a silent chain, which passes round two toothed wheels 31, 32 one of which 31 is fixed coaxially about the support head 22 and the other 30 is supported by a freely rotating shaft 33 supported for rotation in frame 23 about an axis parallel to axis Y of the support head. One of the two sides of the endless chain 30 is connected by a connecting link 34 to the end of the rod 35 of a hydraulic cylinder 36 fixed to the lower wall of frame 23. The free end of the cylinder rod 35 is further mounted for sliding by means of a ball socket 37 along a cylindrical rail 38 parallel to the sides of the chain 30 and fixed by its ends to frame 23.

It will be readily understood that, in this mechanism, the endless chain 30, driven in one direction or in the other by cylinder 36, causes the support head 22 to rotate through an angle determined by the stroke of the cylinder rod, this angular rotation being transmitted to the bending finger 20 which describes an arc of a circle of the same angle at the center, about axis Y.

Figure 4:
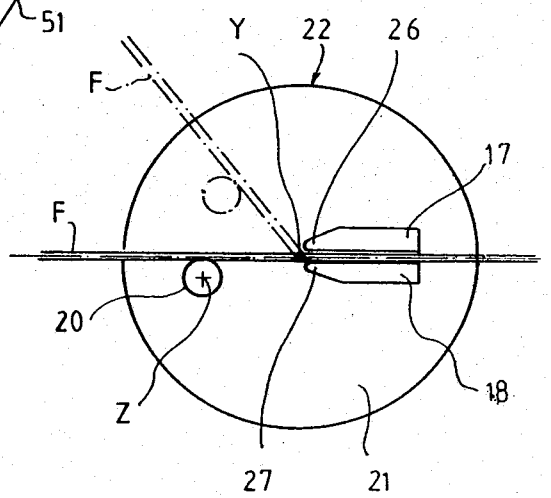
FIG. 4 is an enlarged view of the working face of this bending device, taken in the direction of arrow IV of FIG. 2.

Thus, if a section of wire F or of any other elongate material to be curved is positioned on axis X, while being immobilized on the one hand inside the support nipper 2 and on the other between the two jaws 17 and 18 in the closed position, finger 20 placed in lateral contact with the wire will bend this latter about nose 26 or 27 of one of the jaws, through an angle depending on the amplitude of its angular rotation, such as shown in FIG. 4 with a dash dot line.

It should be noted that for this bending, finger 20 and noses 26 and 27 of the two jaws 17 and 18 are each provided with a groove for receiving the wire F, these grooves having the shape of a V for accomodating any diameter of wire.

Referring to FIG. 2, it can be seen that the bending finger 20 is mounted for sliding in the support head 22 and that it is further associated with a second drive mechanism 39 adapted for imparting thereto a reciprocal movement along an axis Z parallel to the axis of rotation Y of the support head 22.

This second drive mechanism 39 comprises more precisely a pneumatic cylinder 40 fixed externally on the rear wall 41 of frame 23, in which is formed an aperture 42 through which the rod 43 of the cylinder passes. The cylinder rod 43 passes in free sliding relation through the support head 22, along axis Y and, at its free end, emerges into an inner cavity 44 of the support head where it is connected to the bending finger 20 by a rotary connection 45. With such a connection, finger 20 may be rotated about axis Y while being movable in translation by means of the cylinder rod 43, whatever its angular position. Thus, after having formed a bend, finger 20 may be retracted so as to be then placed on the other side of the wire for forming in this latter a bend in the opposite direction, after movement of the bending device with respect to the wire.

It should be further noted, as can be seen in FIG. 2, that the cylinder 19 for actuating the mobile jaw 17 is also fixed to the rear wall 41 of frame 23 and that its rod 46, which extends along the upper wall 47 of this latter, is connected to said mobile jaw 17 by means of a hinged connection not shown.

It will be further added that the three cylinders 19, 36 and 40, just described, are actuated by means of a working fluid from a supply unit through relay 16, and conveyed by flexible ducts **19*a* held inside curved gutters 19*b* which are formed by several U shaped elements 19*c* hinged end to end, so as to be able to follow the movement of the two bending devices 3 and 4 (see FIG. 1**).

Figure 5:
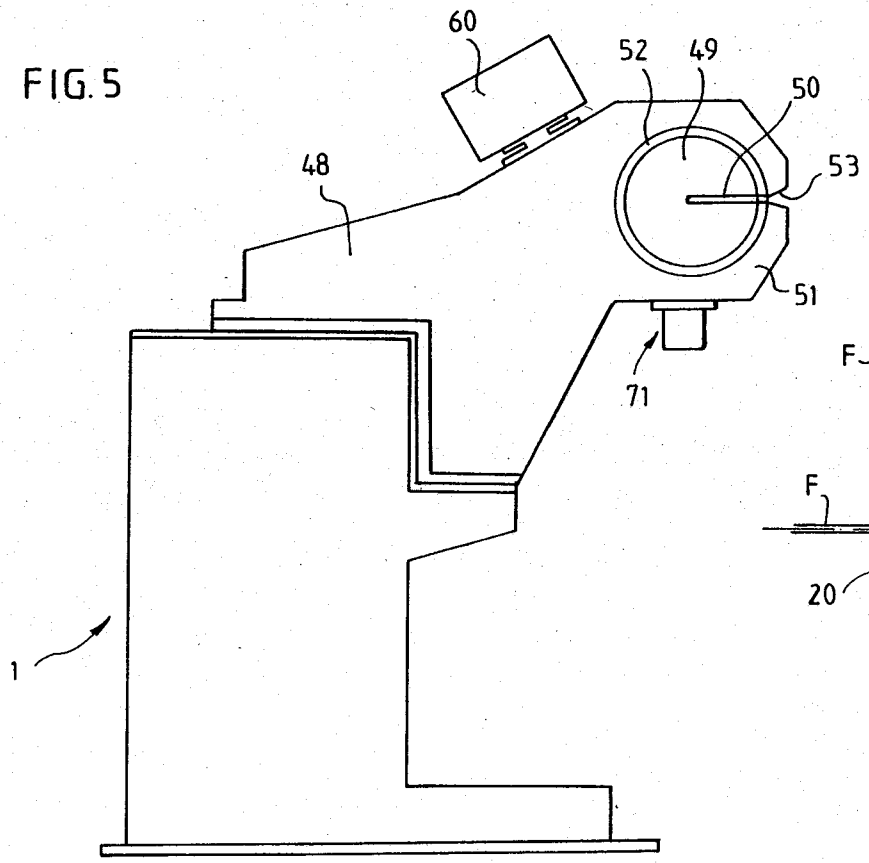
FIG. 5 is a side view of the supporting nipper.
Figure 6:
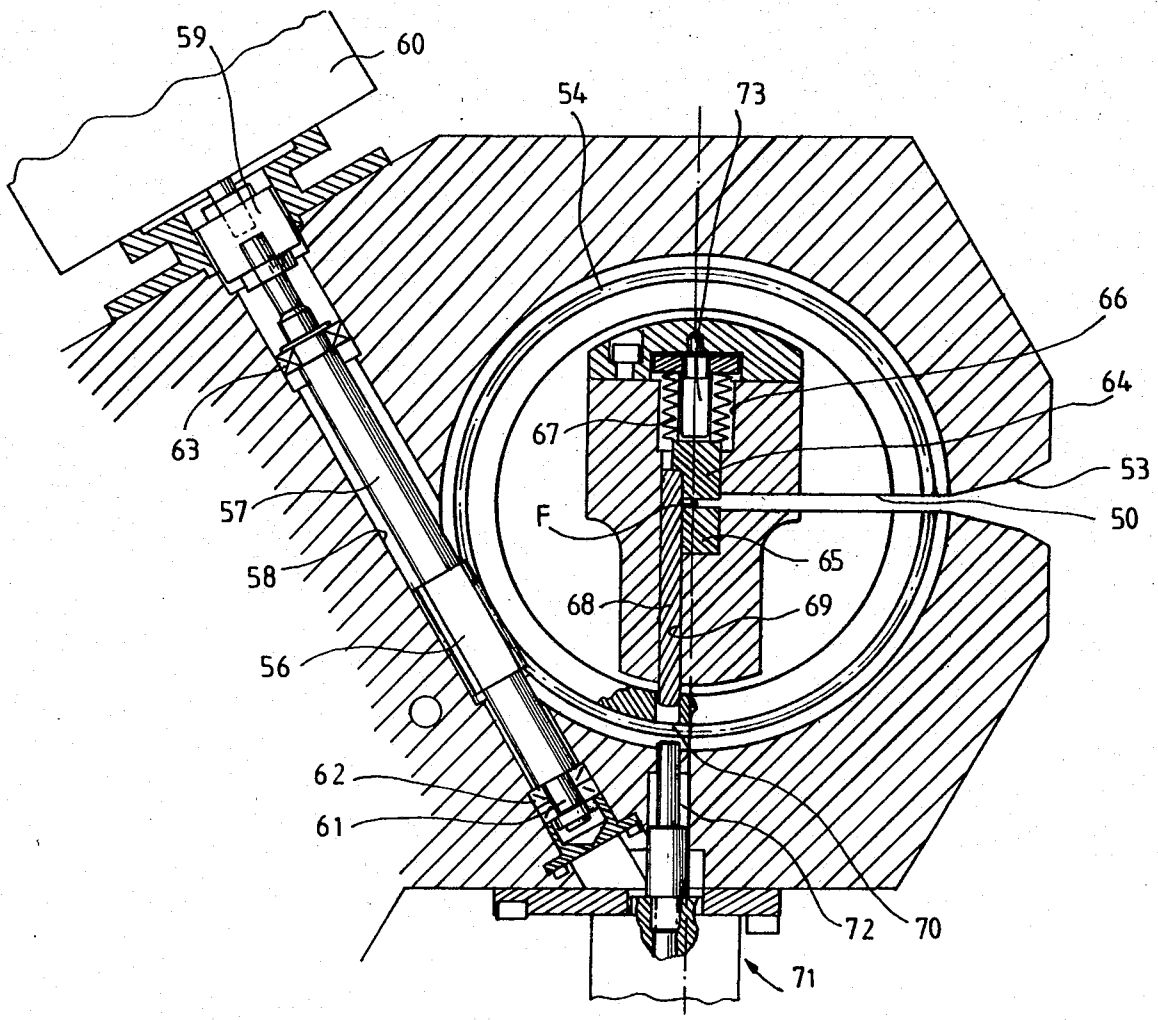
FIG. 6 is an enlarged view in longitudinal section of this nipper.

With reference to FIGS. 5 and 6 the support nipper 2 will now be described.

As can be seen in FIG. 5, the support arm 48 of this nipper is fixed to bench 1 of the machine and the nipper in itself is formed by a circular disk 49, having a radial slit 50 opening at its periphery, this disk being mounted for rotation in a vertical plane and about the axis X shown in FIG. 1, inside an extension 51 of the support arm 48. Disk 50 is more precisely retained in a circular slide 52 supported by the edge of a recess of corresponding shape formed in extension 51 in the front face of which is formed a second substantially V shaped notch 53 which communicates with the slits 50 of disk 49 when this latter is in its rest position shown in FIGS. 5 and 6.

FIG. 6 shows that the disk 49 has at its periphery an obliquely toothed ring 54 which engages with complementary teeth formed on a sleeve 56, itself fixed about a shaft 57 mounted for rotation in an oblique position of tangency with the toothed ring 54, inside a cylindrical housing 58 formed in the support arm 48. At one of its ends, shaft 57 is coupled at 59 to an electric motor 60 supported by arm 48 whereas its other end 61 is retained for rotation in a bearing 62 integral with the wall of housing 58. In the vicinity of motor 60, shaft 57 is further retained inside a bearing 63.

With these arrangements, it will be readily understood that disk 49 may be placed in any angular position under the action of motor 60 which acts on the toothed ring 54 through the toothed sleeve 56 of shaft 57.

In FIG. 6 it can be further seen that disk 49 contains two clamping blocks 64, 65 which project slightly opposite each other, in the center of the disk, from the two edges of slit 50. One of these blocks 65 is fixed whereas the other 64 is mounted for movement inside an inner cavity 66 of the disk, a spring 67 being interposed between the bottom of this cavity 66 and the mobile block 64. Furthermore, this latter is integral with a rod 68 which slides with a snug fit inside a bore 69 extending parallel to the direction of movement of the mobile block 64, this bore opening out at 70 at the periphery of disk 49. Furthermore, on the lower ege of the extension 51 of the support arm 48, is mounted a hydraulic cylinder 71 whose rod 72 may slide inside said extension 51 so as to come into alignment with the bore 69 and penetrate inside this latter when disk 49 is in its rest position shown in FIG. 6.

It will be readily understood that, in this position of the disk, cylinder 71 may be actuated so that its rod 72 pushes rod 68 upwards thus moving the mobile plug 64 way from the fixed plug 65, against the force of spring 67, the movement of the mobile plug being limited by a stop 73.

Thus a section of wire F or of any other elongate metal element to be curved may be engaged between blocks 64 and 65, through the notch 53 of extension 51 and the slit 50 in disk 49. When it is pushed home to the bottom of the slit, and if at the same time it is engaged between the two jaws 17 and 18 of each of the bending devices 3 and 4, the wire section F is thus positioned along axis X. Cylinder 71 may then be deactivated so that the mobile block 64, urged against the fixed block 65 by spring 67, immobilizes wire F in this position.

Subsequently, motor 60, rotating disk 49 about axis X, allows wire F to be orientated in any angular position with respect to the bending fingers 20 of the two bending devices 3 and 4 and so the direction of bending about axis X to be fixed at each stop of the bending devices along rail 7.

The different cylinders 8,9,19, 36, 40 and 71 of the curving machine of the invention are fed with working fluid under the control of a digital control desk which also controls operation of motor 60 for rotating the nipper 2.

The digital control desk contains a reading apparatus in which may be inserted a magnetic tape cassette on which a program is prerecorded in the form of a succession of digital instructions which control and synchronise the operations of the different moving parts of the machine depending on the type of bent wire article it is desired to form.

More precisely, these instructions are relative, for each bending cycle, to the rotational speed and angle of the bending finger 20 about axis Y and of nipper 2 about axis X, to the reciprocal movement of the bending finger 20, to the amplitude of the movement of the two bending devices 3 and 4 and to the opening time of the jaw 17 of these latter.

The program further provides automatic search for the origins of the different movements of the curving machine and management of breakdowns.

It will be readily understood that this programmable digital control considerably increases profitability in the case of medium or small scale industrial production, since changing the type of manufacture only requires one program cassette to be replaced by another. The program of an article may in addition be displayed on a standard video screen in the form of a table and the operator has the possibility of modifying any parameter of the table by the curser of the video screen.

Emphasis should also be laid on the particularly high working speed with which the curving machine of the invention is endowed. By way of illustration it may be stated that the rotational speed of the bending finger about axis Y may reach 277 rpm and that the advancing speed of the bending devices 3 and 4 may reach 1 m/s.

It should be further observed that the curving machine of the invention is of very high precision since the bending finger 20 may execute a minimum angular rotation of 0.04° about the axis of rotation Y of the support head 22, which allows it to form bends along non polygonal curves and more especially along arcs of circles. Furthermore, the advancing precision of the bending devices 3, 4 is ±0.05 mm and that of the angular rotation of nipper 2 is ±0.24°.

The curving machine of the invention has the further advantage of allowing a high production rate since it is equipped with two bending devices which operates simultaneously on each side of the nipper. It should be noted here that the two bending devices may produce different bending configurations in space since they may be programmed individually.

Finally, among the other advantages of the curving machine of the invention, there may be mentioned its great flexibility in use. In fact, it is capable of bending not only metal wires whose diameter may reach 8 mm but also metal strip or ribbon. The machine of the invention may even form bent tubes, more particularly because of the high precision of the second mechanism 39 for driving the bending finger 20 which provides bending through an arc of a circle by successive closely related touches.

We claim:

1. A machine for curving thin and rectilinear sections of a metal element, such as a wire, strip, tube or the like, said machine comprising: positioning means for holding the section to be bent on a first axis, at least one bending member, a counter-bending part placed on said first axis and cooperating with said bending member, a first drive mechanism for driving said bending member with an angular rotational movement about a second axis perpendicular to said first axis and aligned with the counter-bending part, a second drive mechanism for moving said bending member with a reciprocal movement along a third axis parallel to said second axis, said bending member being further movable jointly with the counter-bending part in a direction parallel to said first axis, said positioning means comprising a nipper for immobilizing on said first axis the section to be bent, and also comprising a pair of jaws movable jointly with said bending member, at least one of said jaws being mobile, said jaws having tapered noses which form said counter-bending part, control means associated with said noses for moving the mobile jaw away from the other jaw upon movement of the bending member along the element to be bent, said nipper being mounted for rotation about said first axis, and a third drive mechanism associated with said nipper for imparting thereto an angular rotation about said first axis.

2. A machine according to claim 1, comprising two bending members each associated with a counter-bending part and disposed on each side of said nipper.

3. A machine according to claim 2, wherein said nipper forms a disk having a radial slit opening at its periphery and mounted for rotation about the center of the nipper on a support arm fixed to the machine, said disk further comprising means for clamping the section to be bent.

4. A machine according to claim 3, wherein the clamping members are blocks mounted inside the disk and projecting from the edges of the slit, one opposite the other, in the center of the disk, at least one of said blocks being mobile, and a resilient element urging said one block towards the other block for clamping the element to be bent therewith, and moving means for periodically pushing said mobile block against the action of said resilient element for releasing the element to be bent.

5. A machine according to claim 4, wherein said moving means comprises an actuating cylinder having a rod which, in a certain angular position of said disk comes into alignment with a bore of the disk, open at the periphery thereof and in which slides a rod fixed to said mobile block.

6. A machine according to claim 3, wherein said third drive mechanism comprises a motor, a shaft coupled to said motor and having on a part at least of its length, teeth, and a toothed ring carried by the periphery of said disk, tangent to said shaft and engaging said teeth.

7. A machine according to claim 1, wherein each bending member is a bending finger mounted for sliding along said third axis in a support head which has an axis of symmetry forming said second axis and which is held for rotation about said second axis inside a frame movable along a rail parallel to said first axis.

8. A machine according to claim 7, wherein said first mechanism comprises an endless chain extending parallel to said first axis about two toothed wheels, one of said toothed wheels being fixed coaxially about said support head, and the other toothed wheel being supported by a shaft mounted for free rotation in a frame of the machine, parallel to the axis of rotation of said support head, said endless chain having one side connected to a free end of a first rod of a first actuating cylinder which is arranged parallel thereto.

9. A machine according to claim 8, wherein the free end of said first rod is mounted for sliding along a guide rail parallel to said first rod.

10. A machine according to claim 7, wherein said second mechanism comprises a second actuating cylinder fixed to said frame and having a second rod which passes in free sliding relation through said support head along said second axis, said second rod having a free end connected to said bending finger by a rotary lateral connection.

11. A machine according to claim 10, wherein said mobile jaw is connected by a hinged connection to a third rod of a third actuating cylinder.

12. A machine according to claim 11, comprising a programmable digital control for actuating said drive mechanisms for controlling the movement of said bending members and the third actuating cylinder in synchronism.

* * * * *